United States Patent [19]

McClosky

[11] Patent Number: 4,534,158

[45] Date of Patent: Aug. 13, 1985

[54] PACKAGING MACHINE

[75] Inventor: Robert B. McClosky, Hasbrook Heights, N.J.

[73] Assignee: Wrapade Machine Company, Inc., Clifton, N.J.

[21] Appl. No.: 499,793

[22] Filed: May 31, 1983

[51] Int. Cl.[3] ..... B65B 43/30

[52] U.S. Cl. ..... 53/562; 53/386; 53/570; 493/256

[58] Field of Search ..... 53/455, 568, 570, 562, 53/386; 493/256, 259, 255

[56] References Cited

U.S. PATENT DOCUMENTS

| | | | |
|---|---|---|---|
| 2,272,251 | 2/1942 | Robinson | 53/455 |
| 2,330,361 | 9/1943 | Howard | 53/455 |
| 4,035,988 | 7/1977 | Daniels | 53/386 X |
| 4,108,300 | 8/1978 | Hayase et al. | 53/570 X |
| 4,344,269 | 8/1982 | Dieterlen et al. | 53/455 X |

*Primary Examiner*—James F. Coan

*Attorney, Agent, or Firm*—Caesar, Rivise, Bernstein & Cohen

[57] ABSTRACT

A packaging machine for forming pouches from a continuous web having confronting sections adapted to provide opposed walls of the formed pouches. The machine includes sealing means for sealing the opposed bag walls together in longitudinally spaced-apart regions to provide the side seals of the formed pouches, and a cutting section for cutting the discrete pouches from the sealed continuous web. The machine has positively driven feed means for directing the continuous web material through the cutting means, and the feed means is adjustable in the machine-direction of movement of the web material for controlling the width of the pouches to be formed. Drive means are associated with the driven feed means and include elements movable with the feed means when the feed means is adjusted to thereby automatically change the speed of the feed means to direct the desired amount, or length of sealed web material past the cutting means between operating strokes of the cutting means. Most preferably, the cutting and feed means are retained on connected supporting structure forming a sub-assembly of the machine to thereby cause the cutting and feed means to be adjusted as a single unit.

20 Claims, 15 Drawing Figures

PACKAGING MACHINE

FIELD OF THE INVENTION

This invention relates generally to packaging machines, and more specifically to a packaging machine for forming, filling and sealing packages made from continuous sheet material.

BACKGROUND ART

Packaging machines for forming, filling and sealing flexible pouches are known in the art, and are commonly employed in the packaging of food products, such as soups, vegetables, powdered ingredients, etc. These machines commonly feed a continuous web of flat, packaging material over a folding pan to longitudinally fold the web in half, and thereby define what ultimately will be the front and rear walls of the individual packages. Thereafter, the folded packaging material, having confronting thermoplastic surfaces, are heat sealed in longitudinally spaced-apart regions to define the side margins of the packages. The continuous web is then severed in approximately the center of each side seal to form discrete, open-mouth pouches which are thereafter filled, sealed and thereafter removed from the machine.

Machines of the above-described type generally are adjustable to permit flexible pouches of different widths to be formed thereon. In order to permit pouches of different widths to be formed the machines are designed with an adjustable cutter for severing discrete pouches from the continuous web,and also with adjustable feed rolls for directing the continuous web past the cutter. In certain machines the speed of the feed rolls must be independently set, as a separate step, each time its position is adjusted perparatory to changing the size of the pouches to be formed. Employing a machine which requires separate adjustment of the speed of the feed rolls independently of adjusting the position of the cutter and/or feed rolls can be a time-consuming operation, and in any event, is less desirable than employing a machine wherein the speed of the feed rolls automatically is properly set by the mere act of properly positioning the cutter and feed rolls.

Certain prior art packaging machines for forming and filling flexible pouches are undesirably large; taking up an excessive amount of plant space. Moreover, designing the machine so that it occupies a large area may require the use of extra operators to run it; a factor which may increase manufacturing cost of products packaged on the machine.

Certain prior part packaging machines are quite complex in design and operation. These machines tend to be quite expensive to manufacture, and sometimes unreliable in operation.

The packaging machine of the present invention overcomes the above-described deficiencies associated with prior art packaging machines, and does so in a unique manner.

DISCLOSURE OF THE IVENTION

A packaging machine of this invention forms discrete pouches from a continuous web having confronting surfaces which provide opposed front and rear walls of the pouches to be formed. Preferably the confronting surfaces are established by feeding a continuous flat sheet over a folding pan to thereby fold the sheet along its longitudinal axis as it is being moved in the machine-direction of web travel.

The machine of this invention includes cutting means for cutting the discrete pouches from the continuous web; characterized in that positively driven feed means are provided for directing the continuous web material through the cutting means; said cutting means and feed means being adjustable in the machine-direction of travel of the web for controlling the desired width of the pouches to be formed, drive means associated with the feed means and including elements movable with said feed means for automatically varying the speed of the feed means as it is moved to thereby feed the desired length of continuous web through the cutting means between operating strokes of said cutting means to thereby control the width of the pouches severed from the web.

The machine preferably includes sealing means upstream of the cutting means for sealing the opposed bag walls together in longitudinally spaced-apart regions to form the side seals for the pouches, prior to the cutting operation in which the discrete pouches are separated from the web. Tne positively driven feed means that directs the desired length of the continuous folded web through the cutting means between operating strokes of said cutting means also directs this same desired length of folded web through the sealing means between operating strokes of said sealing means. As a result of this arrangement of elements, the spacing of the side seals from each other will correspond exactly to the width of the pouches to be severed from the continuous web.

Most preferably the cutting and feed means are mounted together on a common support to thereby provide a sub-assembly that is movable as a single unit. In other words, in the preferred embodiment of this invention the cutting and feed means are always maintained a fixed distance from each other, and are moved as a single unit to permit adjustment of the width of the pouches to be formed.

The preferred feed means includes at least one positively driven feed roll; and most preferably includes opposed feed rolls providing a driving nip between them. The drive means employed to vary, or adjust the speed of rotation of one of the feed rolls includes an elongate rocker arm mounted for oscillating motion on a supporting shaft. A rotationally driven gear having a cam roller extending downwardly therefrom for engaging an elongate slot in the rocker arm converts its continuous rotary motion into reciprocating, or oscillating motion of the arm. A sliding toothed rack associated with the sub-assembly carrying the feed roll is movable along the length of the rocker arm as the sub-assembly is adjusted. This rack has a linear driving stroke imparted to it by oscillation of the rocker arm in one direction to rotate the feed roll, and a linear idling stroke imparted to it by the oscillation of the rocker arm in the opposite direction during which the feed roll is not rotated. The length of the driving stroke is directly related to the spacing of the rack from the supporting shaft of the rocker arm; the greater the spacing the greater being the length of the driving stroke. A rotary gear meshing with the toothed rack is secured through a one-way clutch to a rotatably mounted shaft carrying one of the feed rolls. It is this one-way clutch that is responsible for the driving stroke of the rack occurring only during oscillation of the rocker arm in one direction. Oscillation of the rocker arm in the opposite direction will cause the gear meshing with the rack to slip on the rotatably mounted shaft carrying the feed roll, and therefore will not rotate the feed roll. It also should be noted that the speed of rotation of the gear meshing with the sliding rack is directly proportional to the length of the driving stroke of the toothed rack, and accordingly will impart different speeds of rotation to the feed roll depending upon the location of the sliding toothed rack on the elongate rocker arm.

In the most preferred embodiment of the invention a transfer station is located immediately downstream of the sub-assembly carrying the cutting means and feed rolls. The continuous folded and sealed web is fed by the feed rolls through the cutting means and into a gripping nip at the transfer station prior to actuation of the cutting means to sever a discrete pouch from the web. The particular width of the pouch to be formed actually is governed by the spacing of the cutting means from the transfer station. Most preferably, the transfer station includes at least one rotationally mounted roll which, in the preferred embodiment, cooperates with an opposed plate to provide the gripping nip that holds the discrete pouch after the cutting mechanism is operated to sever the pouch from the continuous web.

After severance of the pouch from the web the roll in the transfer station is automatically operated to feed the pouch approximately 2 inches in the machine-direction into a position to be engaged by clamping means carried on a rotatably mounted turret.

Although the inclusion of a transfer station does provide additional room for the clamp on the turret to swing into proper position for receiving a cut pouch, this may be eliminated in certain embodiments of the invention, in which case the continuous web directed through the cutter will be fed directly to the clamps on the turret prior to severing discrete pouches therefrom.

When a transfer station employing a rotatably mounted roller is included in the apparatus, the rotatable drive shaft for the transfer roller preferably constitutes the rotational axis about which the elongate rocker arm is mounted to oscillate. However, the rocker arm is rotatably isolated from the transfer roll shaft so as not to rotate the shaft with it. This is desirable so that the speed of the transfer roll can be set independently of the speed of oscillation of the rocker arm; the frequency of oscillation of the rocker arm being established to postively control the speed of rotation of the feed rolls.

In the preferred drive system an additional gear is secured to the rocker arm and is mounted for rocking motion with the arm about the rotatably mounted shaft carrying the transfer roll. This gear cooperates with an idler gear assembly to thereby oscillate the idler gear assembly in accordance with the oscillatory motion of the rocker arm. A transfer roll drive gear is secured directly to the rotatable shaft carrying the transfer roll through a one-way clutch, and one of the gears in the idler gear assembly cooperates with the transfer roll drive gear to thereby cause said drive gear to likewise oscillate. However, due to the presence of the one-way clutch, movement of the transfer roll drive gear in only one direction, corresponding to oscillation of the rocker arm in one direction, will be transmitted to the transfer roll through its connecting shaft. Movement of the transfer roll drive gear in the opposite direction, corresponding to oscillation of the rocker arm in the opposite direction, will result in slippage of said drive gear on the rotatably mounted shaft of the transfer roll. To insure that oscillation of the rocker arm in the opposite direction does not rotate the shaft of the transfer roll, a second one-way clutch preferably is connected to said shaft independently of the transfer roll drive gear. The one-way clutches employed to assist in driving the feed roll and transfer roll are set so that the driving stroke for the feed roll actually is the idling stroke for the transfer roll, and vice versa.

As explained earlier, the severed pouches engaged in the transfer station are fed by the transfer roll into clamps carried on a rotatably mounted turret. This turret is intermittently driven into a material filling station and a top sealing station. Thereafter, the clamp engaging the pouch is opened to unload the filled and sealed pouch.

The invention employs a unique system at the filling station for opening the pounch preparatory to the filling operation. In this vacuum system opposed vacuum arms are provided adjacent the opposed walls, and a vacuum is established through the arms to act on these pouch walls. Drive means, preferably in the form of pneumatic cylinders, are operable to retract, or separate the opposed vacuum arms at an outwardly and downwardly inclined angle to thereby peel the confronting inner surfaces of the pouch apart adjacent the upper surface thereof.

In the preferred embodiment of this invention the clamps on the turret engage and hold each of the pouches adjacent a sealed side margin thereof; the opposite side margin being unconfined. Most preferably, the drive means for the vacuum arms are set so that retraction of the arms at an outwardly and downwardly inclinded angle also causes the arms to move in a generally linear direction toward the gripped side margin of the bag to thereby foreshorten the pouch during the opening operation. This is the general path of movement that the pouch wants to follow when it is being gripped adjacent one side margin, and the upper end is being opened. In other words, when the pouch is being opened the unconfined side margin thereof will tend to move in a direction toward the gripped side margin by the mere act of peeling the opposed pouch walls outwardly.

The present invention will be more fully explained and exemplified in the following description and claims of a preferred embodiment thereof taken in conjunction with the accompanying drawings, wherein like reference characters refer to similar parts throughout the several views.

DESCRIPTION OF THE BEST MODE OF THE INVENTION

Figure 1:
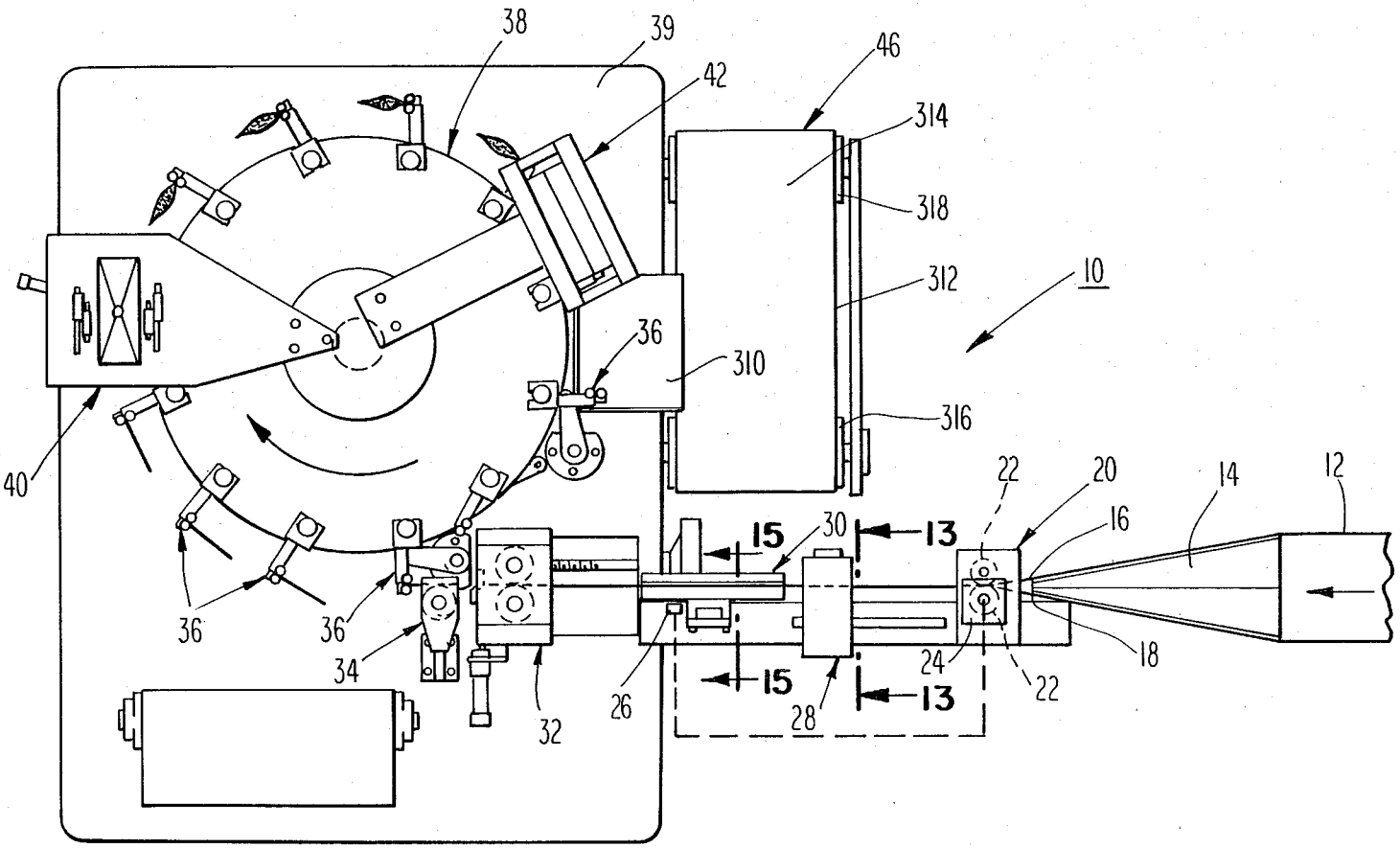
FIG. 1 is a plan view of the packaging machine of this invention showing the general organization of the various parts thereof.

General Organrzation of Elements (FIG. 1)

The overall arrangement of elements in the packaging machine 10 of this invention can be seen best in FIG. 1. The packaging machine 10 receives a flat, flexible web 12, which can be of a wide variety of well-known packaging materials. In the food packaging industry one common web is in the form of a laminate having an outer paper layer, an intermediate foil layer to provide vapor impermeability, and a polyethylene inner layer to permit inner surfaces of the web, when folded, to be thermally bonded together to provide the seals necessary to form a flexible pouch. The flexible web 12 is directed over a folding pan 14 to fold it along its longitudinal axis, and thereby form confronting front and rear walls 16 and 18, respectively, of the discrete pouches to be formed on the packaging machine.

The folded web then is directed through a stretch registering section 20 including opposed idler rolls 22, and an electric brake 24 operated through a photocell 26 to control the tension on the rolls 22 to thereby properly control the position, or location of the folded web material within the machine. This is particularly important for properly aligning printed or graphic material on the web 12 so that the desired material is ihcluded on each of the pouches. To accomplish this registration function the flexible web 12 generally is provided with a series of the spaced-apart eye spots, in a well-known manner, which are capable of being sensed by the photocell 26. The photocell, in turn, controls the stretch registering section 20 to control the position of the folded web in the machine preparatory to forming individual pouches therefrom. The photocell-controlled stretch registering section 20 and its manner of operation are well known, and require no further discussion herein.

Downstream of the stretch registering section 20 is the side sealing section 28 designed to form vertical heat seals in longitudinally spaced-apart sections of the folded web 12 to form the side seams of the pouches.

Downstream of the side sealing section 28 is a bottom sealing section 30 which reinforces the seal at the bottom of the bag. In some cases this bottom sealing section may not be required.

Immediately downstream of the bottom sealing section 30 is a unique feed roll and cutter sub-assembly 32 which includes driven feed rolls for moving, or directing the continuous web through the previously-described upstream sections of the machine 10.

A transfer station 34 is located downstream of the feed roll and cutter sub-assembly 32. This transfer station receives open-mouthed individual pouches from the sub-assembly 32, and thereafter directs the individual pouches into clamps 36 carried on an intermittenly driven turret 38. The turret 38 extends above an upper platform 39 for intermittently directing the pouches through an opening and filling station 40, a top sealing station 42 and a pouch unloading station 44. At the unloading station each filled and sealed bag is released from its clamp 36 and directed onto a takeaway conveyor 46.

DRIVE MECHANISM - GENERAL ORGANIZTION (FIG. 2)

The operation of the packaging machine 10 is controlled through a one-half horsepower d.c. motor 48. This motor operates through a gear and cam arrangement to selectively actuate a series of microswitches for controlling the operation of various pneumatic and/or electrically operated components of the machine. In addition, an extremely reliable gear and linkage arrangement is provided to control the operation of various other machine elements, as will be described in greater detail hereinafter.

CAM-CONTROLLED MICROSWITCH SYSTEM (FIG. 2)

Figure 2:
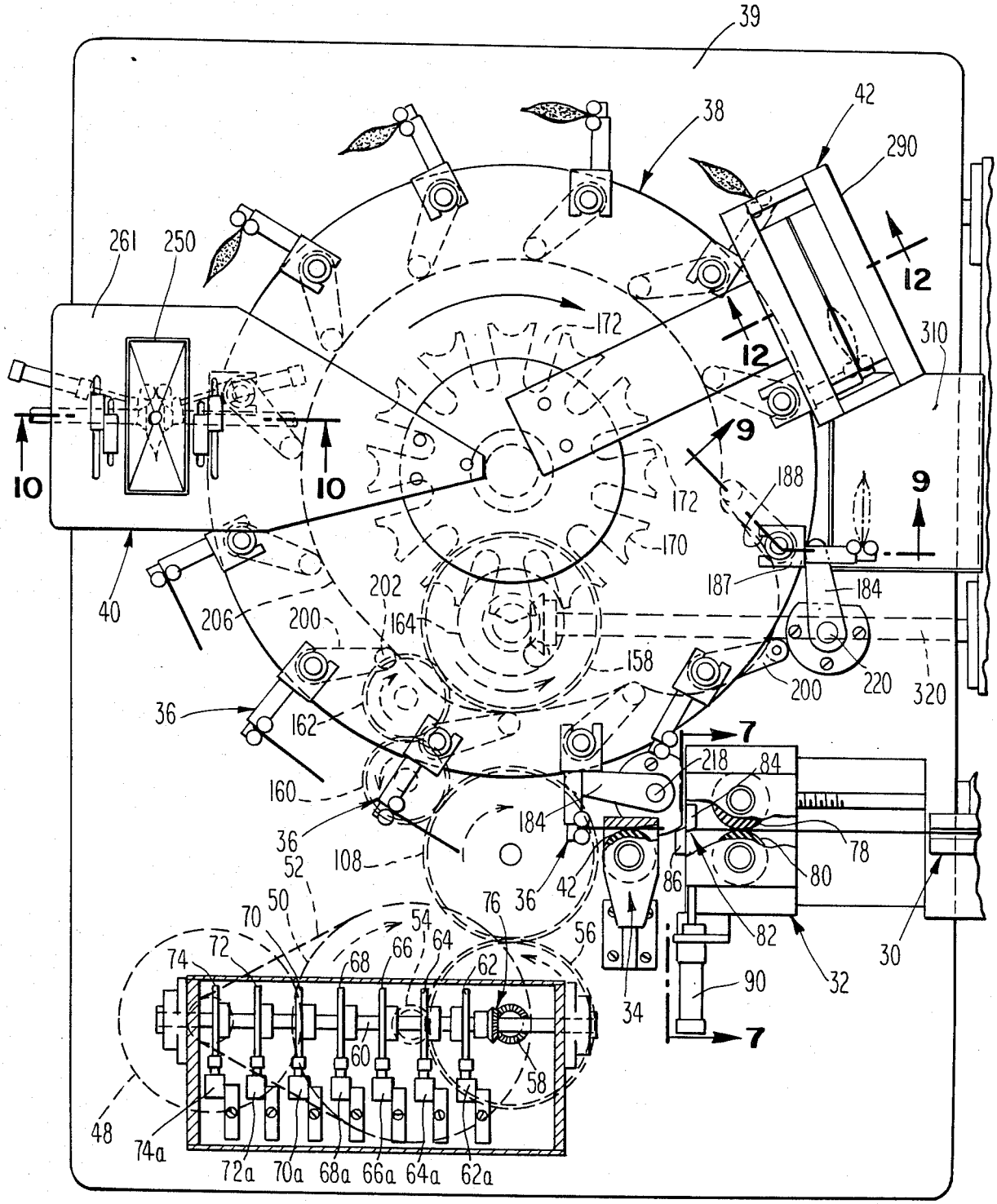
FIG. 2 is an enlarged plan view of the turret section of the apparatus shown on the left in FIG. 1.

As can be seen best in FIG. 2, the d.c. motor 48 drives a pulley 50 through a timing belt 52. A pinion gear 54 is located on the shaft driven through pulley 50, and is located above the pulley to engage and drive a 96-tooth spur gear 56. The shaft 58 attached to this spur gear is rotated to thereby drive a horizontal shaft 60 on which is mounted a series of cams, e.g. 62, 64, 66, 68, 70, 72 and 74 for controlling the operation of various pneumatic and electrical components of the system through the predetermined actuation of cooperating microswitches, e.g. 62*a*, 64*a*, 66*a*, 68*a*, 70*a*, 72*a* and 74*a*, respectively. The horizontal shaft 60, and the various cams carried thereon, are rotated through miter gears 76 which transmit rotory motion to the horizontal shaft through the vertical shaft 58.

In a preferred embodiment of this invention one of the cams is employed to control three distinct pneumatic circuits for operating the top pouch sealing device at station 42, the side sealers at station 28 and the bottom sealers at section 30, respectively. A second cam controls the electro-mechanical system for operating the pouch-filling device at the opening and filling station 40. Two additional cams control the vacuum-creating system and vacuum arm moving system, respectively, at the opening and filling station 40. A further cam controls an air puffer system for directing a puff of air into the initially opened pouch to expand, or further open the lower area of the pouch at station 40, and still another cam controls the knife-actuating pneumatic cylinder at station 32. The last cam controls the electrical system of photocell 26 for operating the electric brake 24 of the stretch-registering section 20.

FEED ROLL AND CUTTER SUB-ASSEMBLY 32 and Transfer Station 34 (FIGS. 2, 4, 5, 7 ahd 8)

The present invention includes a unique feed roll and cutter sub-assembly 32 that is adjustable along the machine-direction of web travel to vary its spacing from the transfer station 34. The position of the feed roll and cutter sub-assembly 32 is varied relative to the transfer station 34 for the purpose of varying the width of the pouches to be formed on the machine. In the preferred embodiment of the invention the sub-assembly 32 is adapted to be spaced anywhere from 2 inches to 6 inches from the transfer station 34 to form pouches having a width variation within the range of 2 to 6 inches.

The transfer station 34 perferably is included in the machine to feed the individual pouches gripped thereby approximately 2 inches into gripping engagement with an adjacent clamp 36 carried on the intermittently driven turret 38. Feeding the individual pouches an additional 2 inches from the sub-assembly 32 provides additional room for each clamp 36 on the turret to swing into proper position adjacent the transfer station 34 for receiving a pouch. In certain emobidments of the invention the transfer station 34, to be described in detail hereinafter, may not be needed.

The feed roll and cutter sub-assembly 32 includes positively driven feed rolls 78 and 80 providing a nip therebetween for directing the continuous folded web 12 through cutting section 82 of said sub-assembly. At this point in the operation the continuous folded web includes longitudinally spaced vertical side seals formed at the sealing section 28. The cutting section 82 is adapted to sever the folded web substantially in the center of the side seals to form discrete open-topped pouches.

Figure 8:
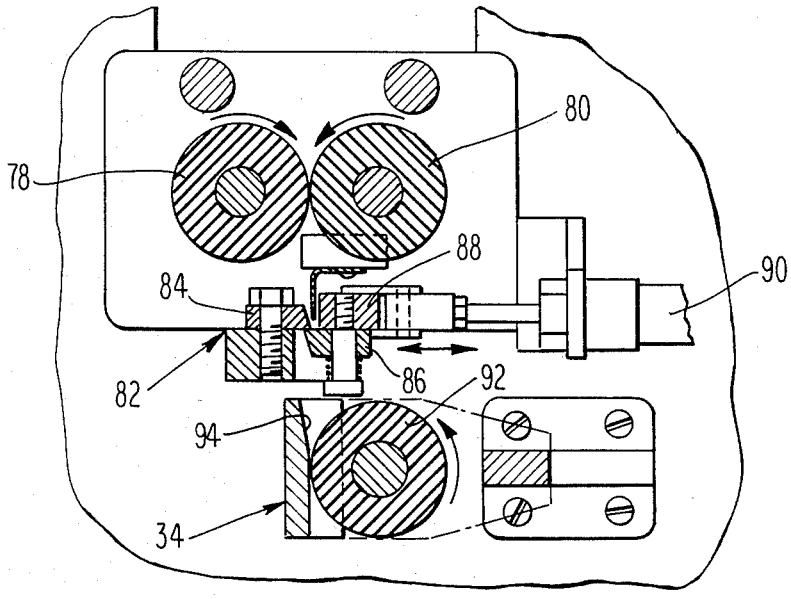
FIG. 8 is a horizontal sectional view taken along line 8—8 of FIG. 7.

The cutting section 82 is provided by a pair of opposed cutting blades 84, 86 (FIGS. 2 and 8), one of which is carried on a pivotal frame member 88 actuated by a pneumatic cylinder 90. The operation of the pneumatic cylinder 90, and therefore the stroke of the cutting blades 84 and 86, is controlled by one of the earlier-described cams and its associated microswitch.

In the preferred embodiment of the invention the web is fed through the cutter section 82 into the nip of the transfer station 34. The transfer station includes a driven transfer roll 92 forming a nip with a confronting plate member 94.

At this point it should be noted that the frequency of the stroke of the cutting blades 84 and 86 remains constant, regardless of the position of the feed roll and cutter sub-assembly 32 relative to the transfer station 34. This means that the speed of the driven feed rolls 78 and 80 must be varied, depending upon the position of the cutter section 82 relative to the transfer station 34, so that a continuous length of web material is always fed into the nip of the transfer station prior to actuation of the cutting blades. This is the mechanism by which the width of the pouches to be formed is varied.

DRIVE ARRANGEMENT FOR FEED ROLLS 78, 80 AND TRANSFER ROLL 92 (FIGS. 2–6)

A unique feature of this invention resides in mounting, or actually forming the feed rolls 78 and 80 and the cutter section 82 as part of a common sub-assembly 32. Because of this arrangement the adjustment of the cutting blades relative to the transfer station 34 correspondingly adjusts the position of the feed rolls relative to said transfer station. The mounting of the feed rolls 78 and 80 and the cutter section 82 on a common sub-assembly is taken advantage of in a unique manner by automatically controlling the speed of the feed rolls based on its position relative to the transfer station 34 to always direct the continuous web 12 past the cutting blades and into the nip of the transfer station prior to the actuation of said cutting blades. The same length of folded web 12 directed past the cutting blades also is directed past the side sealing section 28 between strokes of said side sealing section to thereby seal the continuous folded web 12 in vertical regions that are spaced-apart a distance equal to the desired width of the pouches to be formed. It should be noted that the stroke of the side sealing section 28, like the stroke of the cutting blades 84 and 86, is of a constant frequency controlled by one of the earlier-described cam-operated microswitches.

Figure 3:
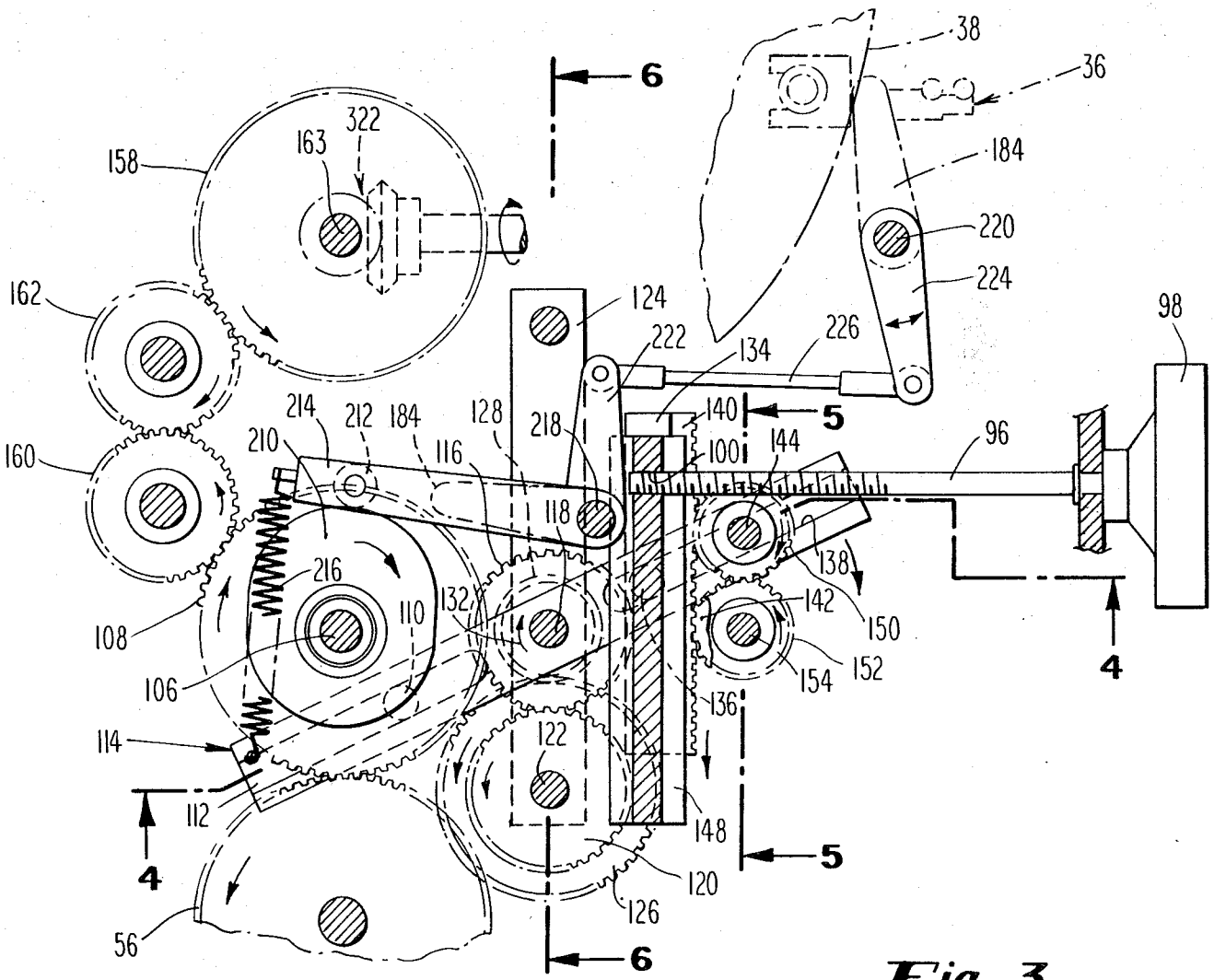
FIG. 3 is a horizontal sectional view along line 3—3 of FIG. 4 taken directly beneath the top plate of the apparatus and showing certain unique features of the drive system.
Figure 4:
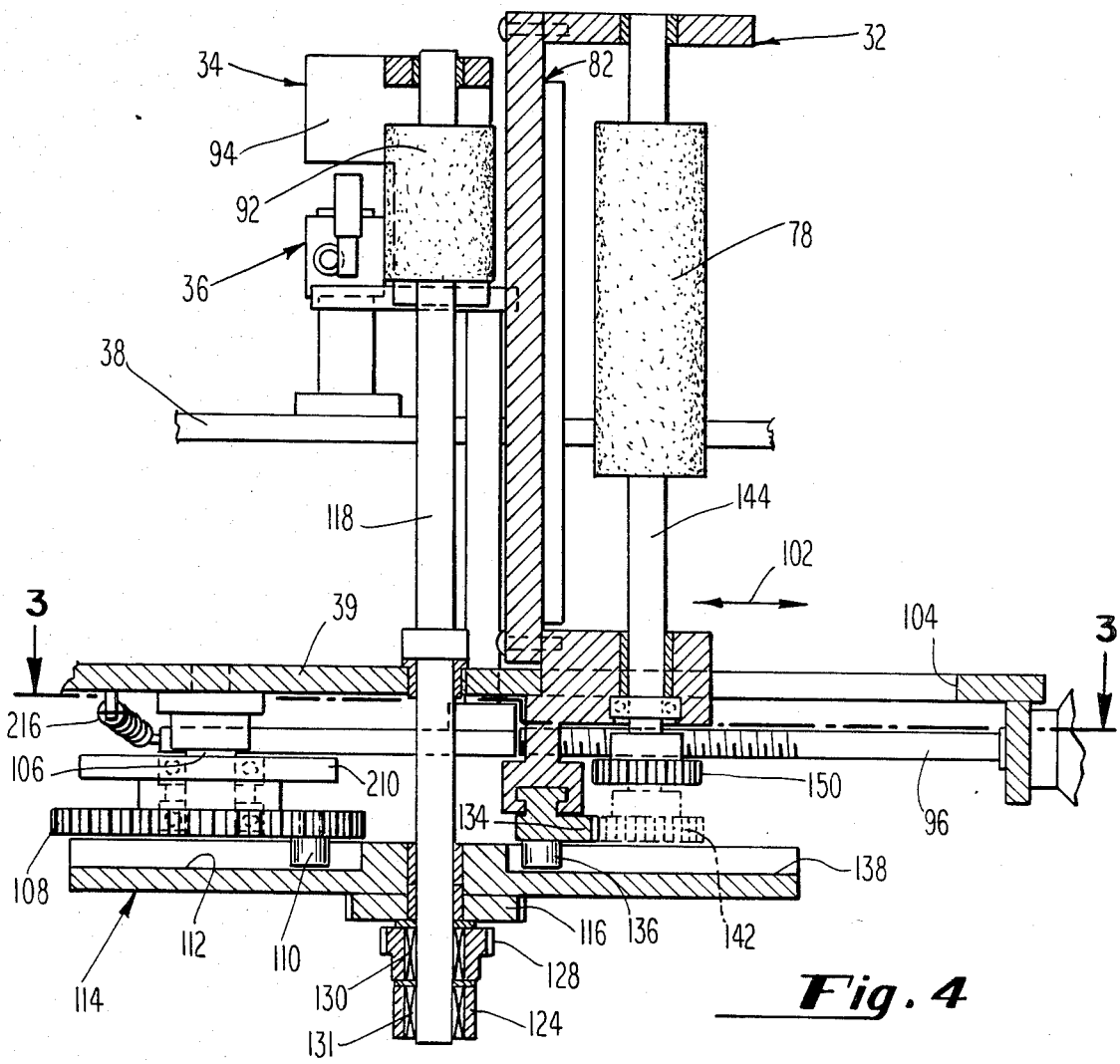
FIG. 4 is a sectional view taken along line 4—4 of FIG. 3.
Figure 5:
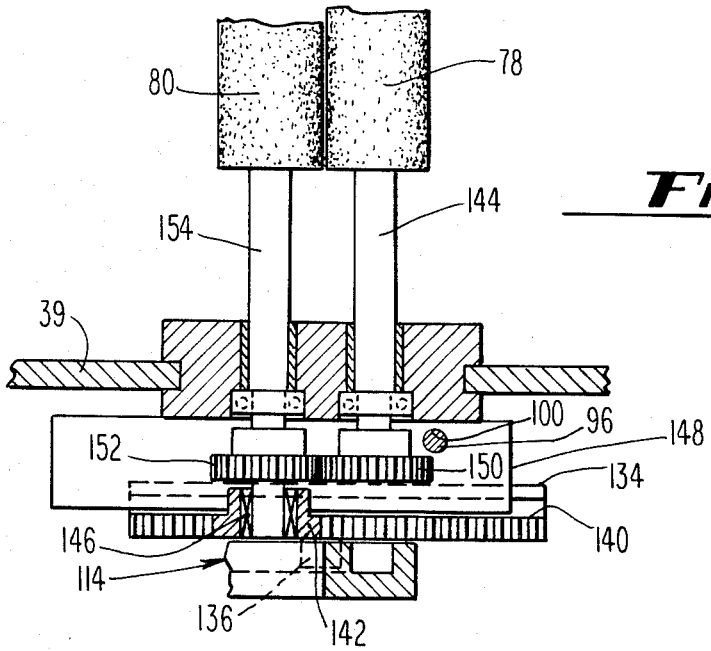
FIG. 5 is a sectional view taken along line 5—5 of FIG. 3.

Referring specifically to FIGS. 3, 4 and 5, a threaded shaft 96 connected to a hand wheel 98 extends into a threaded opening 100 (FIG. 5) forming part of the support for the feed roll and cutter sub-assembly 32. Accordingly, by operation of the hand wheel 98, the subassembly 32 can be moved in the direction indicated by arrow 102 (FIG. 4) in the elongate slot 104 of the upper platform 39. Although the slot 104 is shown as being opened in the drawings for purposes of clarity, in the actual embodiment of the invention overlapping cover plates of a well-known conventional design are employed to constantly maintain a seal over the opening while, at the same time, permitting the desired adjustment of the sub-assembly to take place. In the preferred embodiment of this invention the feed roll and cutter sub-assembly 32 is adapted to be adjusted anywhere from 2 inches to 6 inches from the nip of the transfer station 34 to thereby permit pouches to be formed having widths which vary anywhere from 2 to 6 inches.

Referring specifically to FIGS. 2–4, a nonrotatable rod 106 extends downwardly from, and is retained in the platform 39. A 96-tooth gear 108 is rotatably mounted on the rod 106, and has a cam roller 110 extending downwardly therefrom. This cam roller 110 seats in an elongate cam groove 112 located in a rocker arm 114. The gear 108 is rotatably driven by the 96-tooth spur gear 56, as can be seen best in FIGS. 2 and 3, and the continuous rotation of gear 108 will be transmitted, through the cam roller 110, into a rocking, or oscillating movement of the rocker arm 114.

Figure 6:
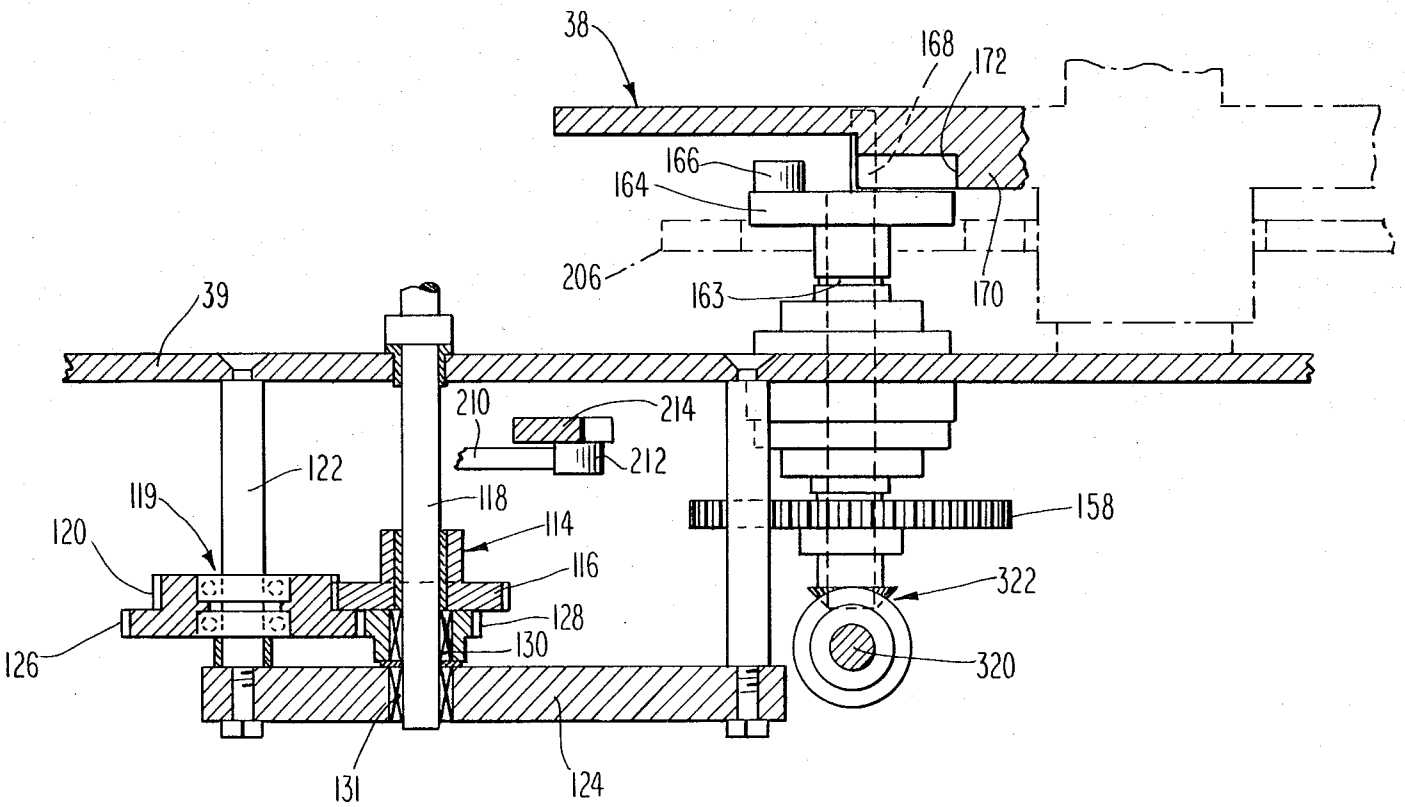
FIG. 6 is a sectional view taken along line 6—6 of FIG. 3.
Figure 7:
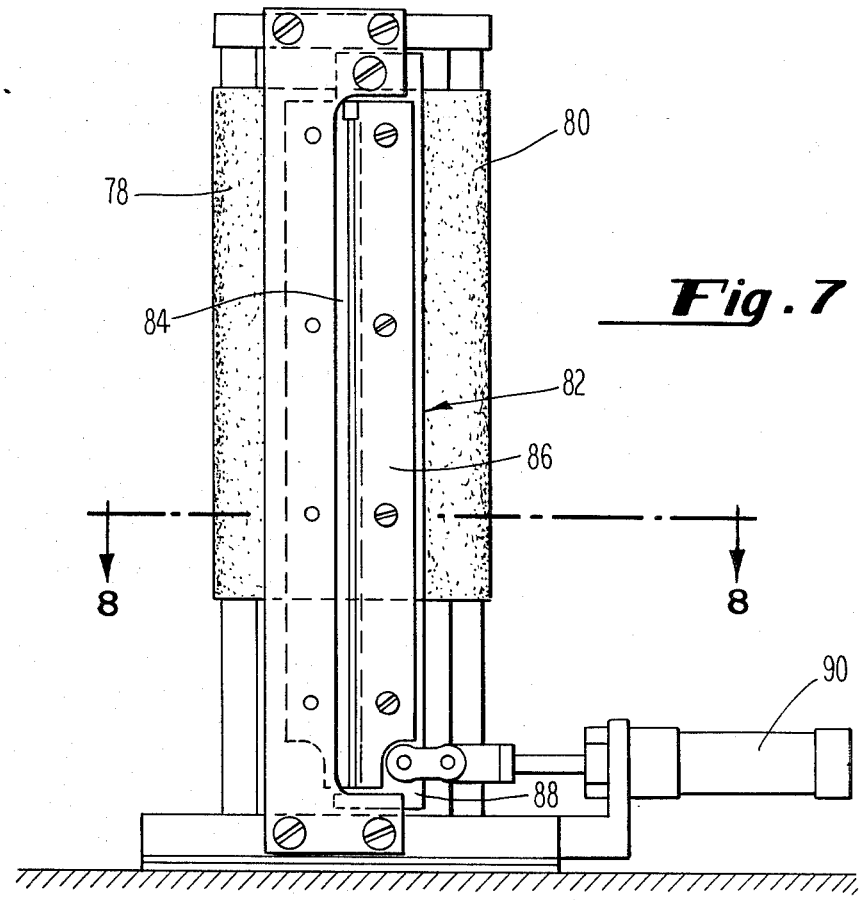
FIG. 7 is a sectional view taken along line 7—7 of FIG. 2.

Referring specifically to FIGS. 3–6, a 52-tooth gear 116 is attached to the rocker arm 114 at the bottom thereof, and therefore will rock, or oscillate with said arm. Moreover, the rocker arm 114 and the gear 116 attached to it are rotatably journaled on a vertical axle or shaft 118 which, in turn, carries the vertically oriented transfer roll 92 located at the transfer station 34. Because of this arrangement the rocking movement of arm 114 will not be directly transmitted to the axle 118; the desired speed of rotation of the axle 118 and its attached transfer roll 92 being acheived through the cooperation of an idler gear system 119. In particular, a 52-tooth idler gear 120 rotatably mounted on a fixed shaft 122 (FIGS. 3 and 6) meshes with the 52-tooth rocking gear 116; the fixed shaft 122 being secured to the upper platform 39 and a lower elongate support section 124 that likewise is secured to the platform 39 (FIG. 6). The idler gear 120, by virtue of its engagement with rocking gear 116 will likewise be rocked, or oscillated at the same frequency as said rocking gear. However, a 72-tooth gear 126 attached to the idler gear 120 meshes with, and drives a 32-tooth gear 128 connected directly to the transfer roll axle 118 through a one-way clutch 130. In this manner the oscillating motion transmitted to the gear 128 will only be effective to rotate the transfer roll shaft 118 in one direction, i.e., counterclockwise as viewed in FIG. 3. In other words, the one-way clutch 130 will only engage with the transfer roll shaft 118 when the gear 128 is oscillating, or rotating in a counterclockwise direction, as viewed in FIG. 3. In the opposite direction of rotation, as indicated by arrow 132, the clutch 130 slips, and therefore will not impart a driving force to the transfer roll shaft 118. However, to insure that the rocker arm does not impart an undesired reverse rotation to the shaft 118 through its bearing system, an additional one-way clutch 131 is secured directly to the shaft, independently of gear 128.

The segment of the rocker arm stroke during which the transfer roll shaft 118 is not being drivein, which is the clockwise stroke about to commence in FIG. 3, will actually drive the driven feed rolls 78 and 80, in a manner now to be described.

Referring specifically to FIGS. 3–5, an elongate slide 134 has a cam follower 136 extending downwardly therefrom and being seated within an elongate groove 138 in the upper surface of the rocker arm 114. This groove can be identical to the groove 112, but is located on the opposite side of the transfer roll axle 118 about which the arm 114 is adapted to oscillate. The particular location of the follower 136 in the groove 138 is determined by the relative location of the feed rolls 78 and 80 within the elongate slot 104, and therefore by the position of the sub-assembly 32.

An elongate rack 140, having teeth on an elongate edge thereof, is carried by the slide 134 (FIG. 3), and the rack 140, in turn, cooperates with a 32-tooth gear 142 connected to the axle, or shaft 154 of one of the feed rolls 80 through a one-way ciutch 146. This one-way clutch is identical to the earlier-referenced one-way clutch 130, but functions to engage shaft 154 during the clockwise stroke of the rocker arm 114 (FIG. 3) in which the clutch 130 slips on its axle, or shaft 118.

The slide 134 is carried in a slide support member 148 which is either formed as part of, or is attached to a lower movable support forming part of the feed roll and cutter sub-assembly 32. Accordingly, adjustment of the sub-assembly within its elongate slot will move the slide support member 148, the slide 134, the cam follower 136 within the elongate groove 138 of the rocker arm 114 and the elongate rack 140 and its cooperating gear 142.

The reciprocation of the elongate slide 134 and its attached rack 140 within slide support member 148, caused by the rocking of arm 114, will oscillate the gear 142. However, the one-way clutch 146 interconnecting the gear 142 to the feed roll shaft 154 will permit rotation of the shaft 154, and its attached feed roll 80, only in one direction. As a result of the arrangement of the one-way clutches 146 and 130, as explained earlier, the rotation of the feed roll 80 occurs during the portion of the rocker arm cycle that the transfer roll shaft 118 is not being rotated.

Referring specifically to FIGS. 3 and 5, the shaft 154 on which the feed roll 80 is mounted also includes a 32-tooth gear 152 secured to it for cooperating with a similar 32-tooth gear 150 secured to a vertical shaft 144 which, in turn, carries the opposed feed roll 78. In this manner positive rotation of the axle 154 through the one-way clutch 146 will be transmitted through gears 152 and 150 into rotational motion of the opposed feed roll 78 to provide the desired positive driving system to feed the continuous web 12 past the cutter section 82 of the sub-assembly 32, and through the stations upstream of said sub-assembly.

As indicated earlier, adjustment of the feed roll and cutter sub-assembly 32 through operation of the hand wheel 98 will move the elongate slide 134 and its cam follower 136 in the elongate groove 138. This, in turn, varies the distance of the elongate rack 140 carried in the slide 134 from the rocking axle 118 of the rocker arm 114. The length of the linear driving stroke of the rack 140 (e.g. the stroke during which feed roll 80 is being rotated) is proportional to its spacing from the rocker arm axle 118. Stating this another way, the further from axle 118 that the rack 140 is located, the greater the length of the driving stroke. However, the time of the driving stroke is constant, regardless of the position of the rack along the rocker arm 114. Accordingly, the difference in the length of the driving stroke will be translated into a difference in rotational speed of the feed roll 80; the greater feed roll speed being associated with the longer driving stroke, and the driving stroke being longer as the sub-assembly 32 is moved farther away from the transfer station 34. The system preferably is designed so that the length of the driving stroke of the rack 140 always is identical to the length of the folded web that is fed past the cutting blades by the rotation of the feed rolls 78 and 80 during said driving stroke, and also is identical to the spacing of the cutting blades from the transfer station 34. Regardless of the position of the sub-assembly 32, a continuous length of folded web 12 will be directed past the cutter section 82 and into the nip of the transfer station 34 prior to actuation of the opposed blades 84 and 86 of said cutter section 82.

TURRET DRIVE SYSTEM (FIGS. 2, 3 and 6)

As explained earlier, the 96-tooth gear 108 is rotatably driven by the 96-tooth spur gear 56. This gear 108 drives a 96-tooth gear 158 through a pair of 42-tooth idler gears 160 and 162. The gear 158 is keyed to a vertical shaft 163 carrying a geneva drive disk 164 to thereby continuously rotate the disk. The drive disk 164 includes a drive pin 166 and a segmented holding pin 168. A geneva star wheel 170, either formed integrally with, or secured to the turret 38 includes a series of 12 slots 172 about its periphery, and these slots are engaged by the drive pin 166 to intermittently index the turret 38 in 30-degree increments. The segmented holding pin 168 engages within a slot of the star wheel 170 to positively maintain the turret 38 in each of its stationary positions. The geneva drive employed in this invention is of a conventional, well-known design, and does not require any further description herein.

Figure 9:
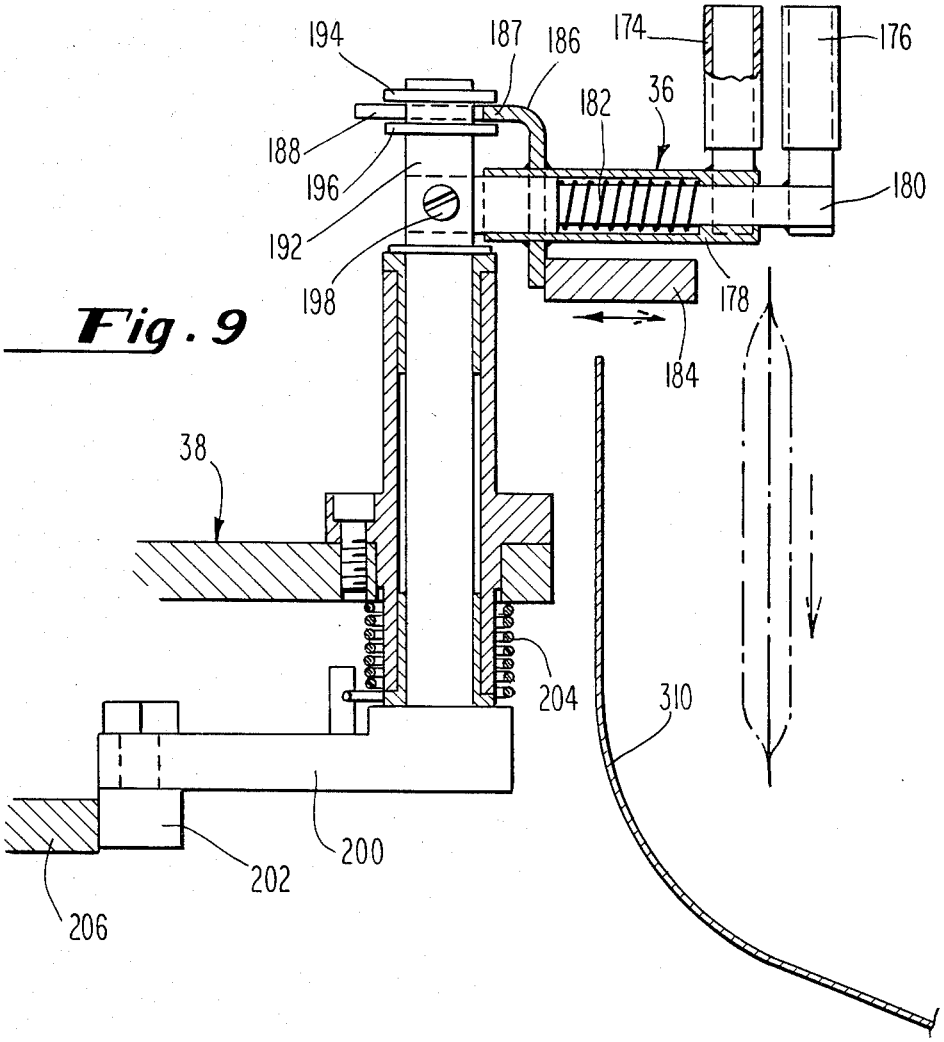
FIG. 9 is a sectional view taken along line 9—9 of FIG. 2.

TURRET CLAMPS AND OPERATION THEREOF (FIGS. 2, 3 and 9)

A plurality of clamps 36, preferably 12, are carried on the intermittently driven turret 38. Each of these clamps is adapted to receive a discrete, open-mouthed pouch immediately downstream of the transfer station 34, and thereafter direct the pouch through the filling station 40, the top sealing station 42 and the discharge station 44. All of the clamps are identical, and, as can be seen best in FIG. 9, include vertically oriented clamping rollers 174, 176 carried, respectively, on telescoping members 178 and 180 that normally are biased by a compression spring 182 to maintain the clamping rollers 174 and 176 in a closed condition. Identical clamp actuating arms or links 184 are provided at the loading and unloading stations for opening the clamping rollers 174 and 176. As is illustrated best in FIG. 9, each actuating arm 184 is operated to press inwardly against a lower end of an L-shaped member 186 welded directly to the outer telescoping member 178. The L-shaped member 186 includes a horizontal arm 187 having a generally U-shaped passage 188 therein to permit sliding movement of the member 186 between opposed flanges 194, 196 of a plastic bobbin that is free to float on vertical post 192. This sliding movement permits the outer telescoping member 178 to be moved relative to the inner member to thereby open the clamping rolls 174 and 176. The inner telescoping member 180 is secured by a suitable fastening means, such as by a screw 198, to the vertical post 192 so that the telescoping members 178 and 180 will maintain their proper orientation relative to each other, and also rotate as a single unit with the upwardly extending post 192.

Referring to FIGS. 2 and 9, each of the vertical posts 192 is secured to a horizontally disposed link 200, and the outer end of each link has a cam follower 202 attached to it. The horizontal link 200 is biased by a torsion spring 204 to maintain the cam follower 202 in engagement with a cam 206. This cam 206 is designed to control the rotational movement of each of the clamps 36 so that they are in their desired positions at the various different stations on the turret. In the illustrated embodiment, and as is seen best in FIG. 2, the cam 206 varies the angular relationship of each clamp as it is moved from the loading station adjacent transfer station 34 into the bag opening and filling station 40. Thereafter, each clamp 36 is maintained in a constant angular position until the pouch has been discharged at the unloading station 44. Thereafter, the cam follower 202 will follow a lobed portion of the cam member 206 to swing each clamp 36 back into proper position at the loading station to receive another pouch from the transfer station 34.

It should be noted that the clamp actuating arms or links 184 are located only at the loading and unloading stations, since it is only in these two stations that the vertically oriented clamping rollers need to be opened. The manner in which the clamp actuating arms 184 are controlled, or operated will now be described with specific reference to FIGS. 2, 3 and 4. As can be seen best in FIG. 2, the clamp actuating arms 184 are shown in the position they normally occupy at the loading and unloading stations.

Referring to FIGS. 3 and 4, a cam 210 is bolted to the 96-tooth gear 108 and therefore is rotated therewith. A cam follower 212 attached to a cam arm 214 is biased into engagement with the cam 210 through a spring 216. The cam arm 214 is secured to a vertical shaft 218 to thereby cause the shaft to rotate in response to movement of the arm created by cam 210 and its corresponding follower 212. Rotation of the shaft 218 will likewise rotate the link 184 attached to it at the loading station to bias the vertically oriented clamping rollers 174, 176 into an open position in exactly the same manner as described earlier in connection with the clamp 136 at the unloading station. The rotation of the shaft 218 is transmitted to shaft 220 carrying the other actuating link 184 at the unloading station through a pair of links 222, 224 and a connecting turnbuckle 226. The link 222 is secured to the vertical shaft 218 to rotate with it, and thereby transmit motion to the turnbuckle 226 and the link 224. The link 224 is connected to the shaft 220 to thereby rotate said shaft and the clamp actuating link 184 attached thereto.

POUCH OPENING AND FILLING STATION 40 (FIGS. 2, 10, 11)

Referring first to FIG. 2, the particular fill device 250 employed will depend upon the material which is being introduced into the pouch. In the packaging of powder or granular foods it is common to employ conventional volumetric feeders, such as commercially available auger feeders. Since the particular fill device can be of a conventional design, and does not form a part of the present invention, there is no need for a further description of such devices in this application.

Figure 10:
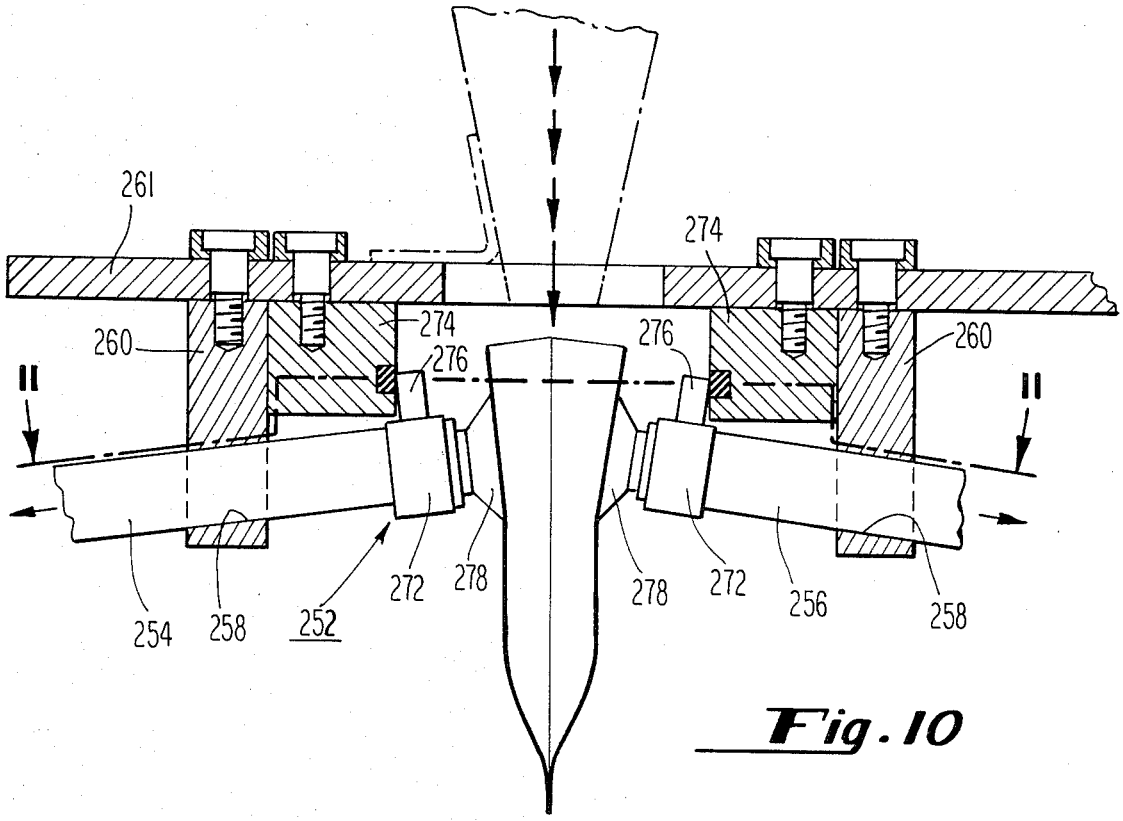
FIG. 10 is a sectional view taken along line 10—10 of FIG. 2.
Figure 11:
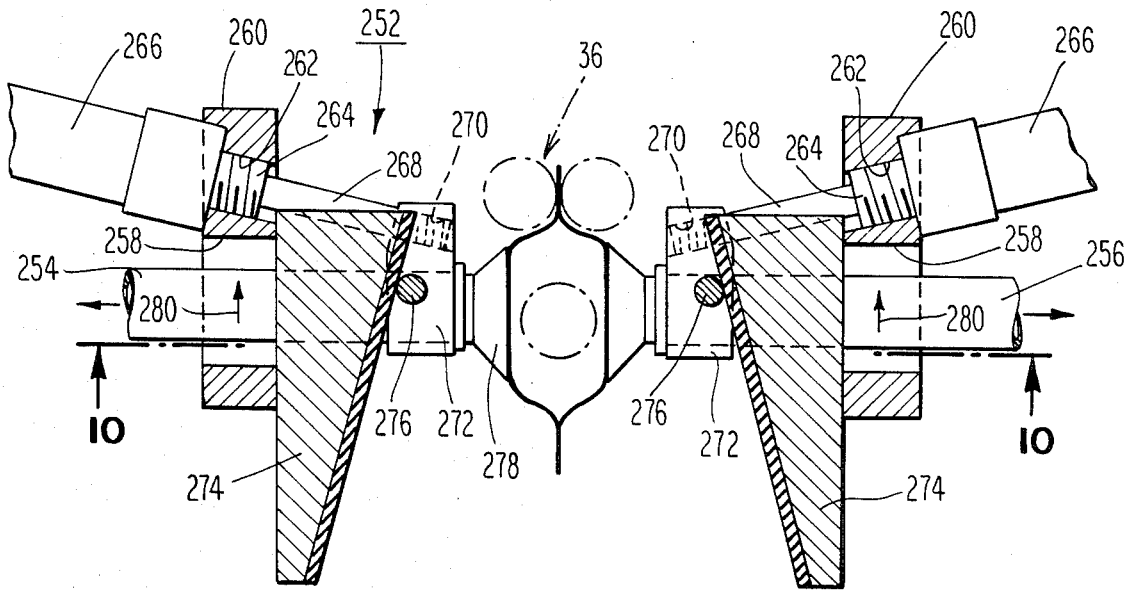
FIG. 11 is a sectional view taken along line 11—11 of FIG. 10.

The machine 10 does employ a unique pouch opening system 252 for opening the pouch at the fill station so that the pouch can receive the material to be packaged therein. Specifically, the system employs opposed vacuum arms 254, 256 which are inclined downwardly from the horizontal axis at an angle of approximately 7 degrees, as viewed in elevation in FIG. 10. Each vacuum arm extends through an elongate opening 258 disposed in a mounting block 260. Each mounting block is secured to a fixed frame member 261 (FIGS. 2 and 10), and can be adjusted laterally in that frame member to permit proper positioning of the vacuum arms, depending upon the actual width of the pouch to be opened. Each mounting block 260 further includes a threaded passage 262 adjacent one end thereof for receiving the threaded end 264 of a pneumatic cylinder 266. This threaded passage is oriented approximately 13 degrees from the horizontal as viewed in plan view (FIG. 11), and approximately 7 degrees downwardly from the horizontal, as viewed in elevation (FIG. 10). The rod or stem 268 within in each cylinder 266 is secured within a threaded opening 270 of a respective stem holder 272. This latter threaded opening likewise has an inclination of approximately 13 degrees to the horizontal, as viewed in plan, and a downward inclination of approximately 7 degrees as viewed in elevation. Each stem holder 272 also is secured to a respective vacuum arm 254 and 256 to actually move the vacuum arms with them upon retraction of the stem 268 within the pneumatic cylinders 266. To limit the amount of retraction of the vacuum arms an adjustable wedge-shaped block 274 is positioned to engage an upstanding lug 276 attached to each of the stem holders 272. The end of the vacuum arms adjacent the front and back walls of the pouch include vacuum cups 278 secured thereto, and these cups have flexible lips normally lying in a plane substantially perpendicular to the axis of the vacuum arms. Prior to establishing a vacuum through the arms the lips of the cups 278 are pressed into sealing engagement against the opposed front and back walls with the edges of the cup lips lying substantially in the same plane as the bag walls. Once the vacuum is established through actuation of one of the earlier-described cam operated microswitches, a second cam-operated microswitch is actuated to operate the pneumatic cylinders 266 to retract the vacuum arms. Due to the orientation of the cylinders the vacuum arms are pulled outwardly and downwardly at a 7-degree angle to acutally peel the front and back walls of the pouch away from each other, as is illustrated best in FIG. 10. The peeling action is enhanced by the lips of the vacuum cups tending to return to their unstressed orientation perpendicular to the longitudinal axes of the vacuum arms. Moreover, the vacuum arms also are moved in a linear direction, as indicated by arrows 280 in FIG. 11, to thereby move the unsupported vertical side of the pouch toward the side of the pouch that is supported by the clamp 36. This downward movement of the front and back walls, accompanied by movement of the unsupported vertical end of the pouch toward the gripped, or supported end of the pouch, closely simulates the most desirable movement of the front and back walls of a flexible pouch supported in the manner contemplated by the present invention as said pouch is being opened. To assist in fully opening the pouch, particularly in the bottom area thereof, a conventional puffer (not shown) is controlled through one of the cam-controlled microswitches to direct a puff of air into the pouch after the vacuum arms have been retracted.

Figure 12:
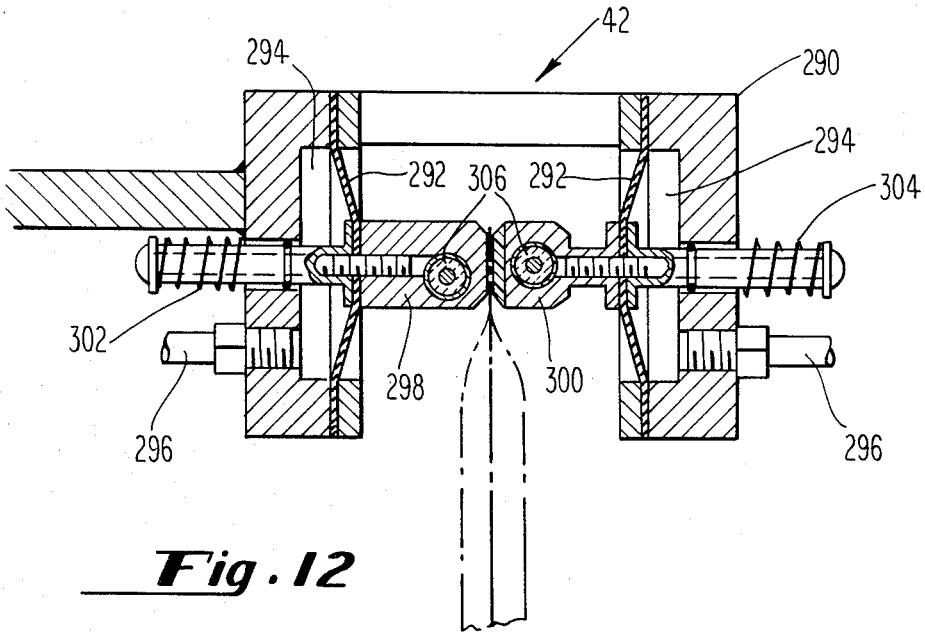
FIG. 12 is a sectional view taken along line 12—12 of FIG. 2.

TOP SEALING STATION (FIGS. 2 and 12)

The top sealing station 42 employs a diaphram-operated heater system 290 for pressing and heating the open end of the pouch to cause the thermoplastic inner layer thereof to melt and positively seal the pouch. As can be seen best in FIG. 12, this heater 290 includes opposed flexible rubber diaphrams 292 overlying chambers 294 into which a positive pressure can be introduced through inlet lines 296. Pressure-creating air actually is introduced into the chambers 294 under the control of one of the earlier-described cam-operated microswitches. Attached to the diaphrams are vertically oriented heat conductive sealing blocks 298 and 300, respectively, and these blocks are normally biased into an open position by springs 302 and 304, respectively. Each of the blocks 298 and 300 is heated by a heating rod 306 extending into an elongate passage of said blocks. The heat from the blocks is transmitted to the pouch when the diaphrams are biased outwardly to press the confronting surfaces of the blocks 298, 300 toward each other. After the desired seal has been produced the pressure in the chambers 294 is dissipated; thereby permitting the springs 302 and 304 to open the blocks and release the package.

UNLOADING STATION (FIGS. 1, 2 and 9)

After the top sealing operation the sealed pouch is directed to the next station, which is 30 degrees from the sealing station, at which location the clamp 36 is actuated, as described earlier in connection with FIG. 9, to open the clamping rollers 174 and 176, and thereby release the sealed and filled pouch. The pouch is allowed to fall directly into a chute 310 which guides it onto a continuously moving conveyor 312. This conveyor is provided by a continuous belt 314 which is disposed about a pair of spaced rollers 316 and 318.

As can be seen best in FIGS. 1, 2 and 6, the roll 316 is positively driven through a horizontal shaft 320 to provide continuous movement to the conveyor 312. Rotational motion is transmitted to the horizontal shaft 320 through a bevel gear arrangement 322 which communicates the horizontal shaft 320 with the vertical shaft 163 driven through the 96-tooth gear 158 (FIG. 6).

Figure 14:
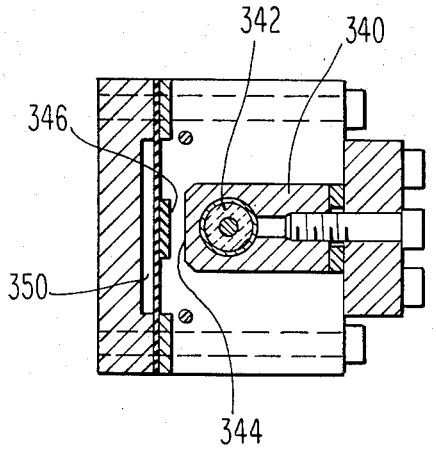
FIG. 14 is a horizontal sectional view taken along line 14—14 of FIG. 13.
Figure 13:
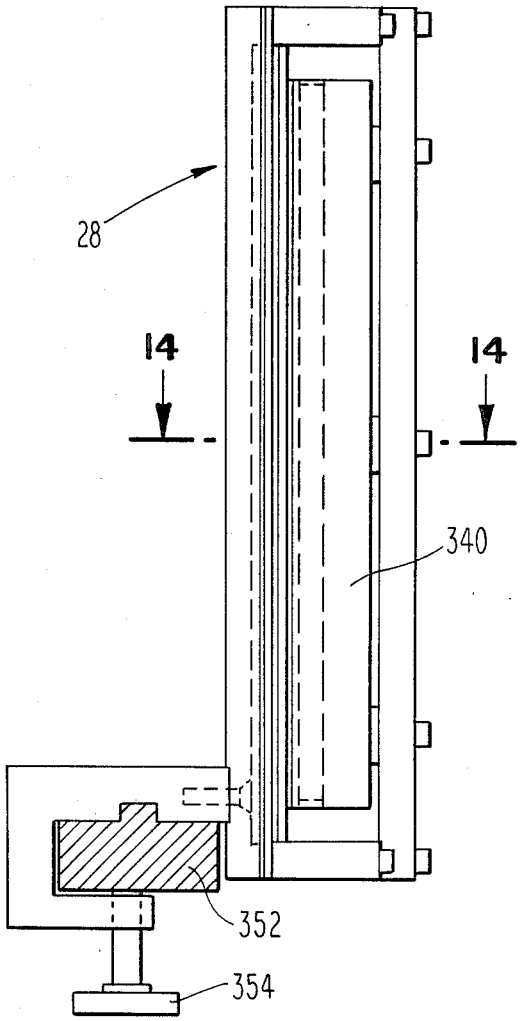
FIG. 13 is a sectional view taken along line 13—13 of FIG. 1.

VERTICAL SIDE SEALING SECTION (FIGS. 1, 13 and 14)

The vertical side sealing section 28 employs an elongate conductive block 340 adapted to engage one flat surface of the pouch. This conductive block is provided with a vertical passage for receiving a heating rod or element 342 from which heat is introduced into the sealing section. The outer surface 344 of the block is adapted to cooperate with a vertically oriented silicone rubber pad 346 having a width corresponding to the width of the vertical side seal to be formed in the pouches. This silicone rubber pad is unheated, and is secured to a flexible rubber diaphram 348 retained over a chamber 350 into which pressurized air can be introduced through a suitable inlet (not shown). In operation pressurized air is introduced into the chamber 350 to force the rubber pad 346 into pressure relationship with the outer surface 344 of the block 340 under the control of the same cam-operated microswitch that controls the operation of the top sealing station 42. In this manner the folded flexible web 12 positioned between the pad and block will be subjected to heat and pressure to form the vertical side seals.

Referring to FIG. 13, side sealing section 28 is linearly adjustable along the main frame 352 of the device, and can be retained in its desired position through operation of the tightening bolt 354.

Figure 15:
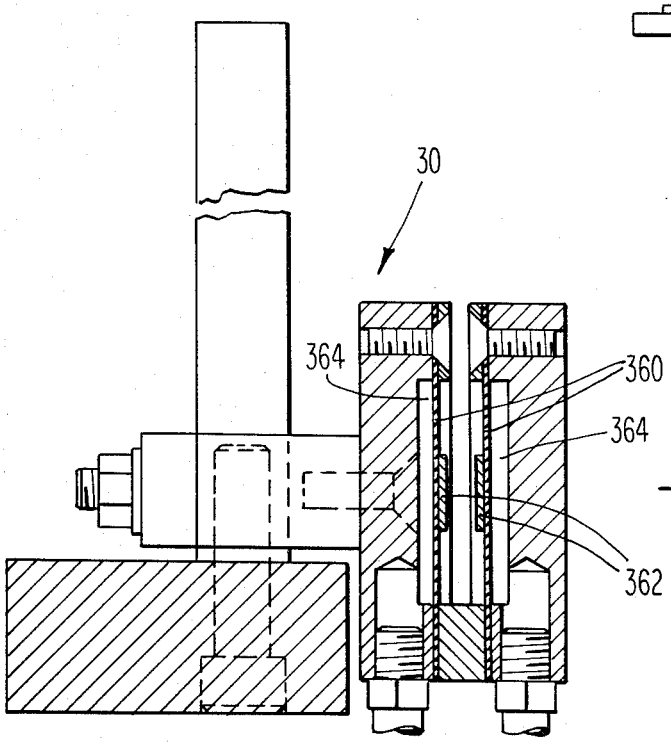
FIG. 15 is a sectional view taken along line 15—15 of FIG. 1.

BOTTOM SEALING SECTION (FIGS. 1 and 15)

The bottom sealing section may, in certain packaging systems, be omitted. However, in most applications it is desired to provide an additional bottom seal, even though the longitudinal fold line does provide some sealing capability. Specifically, it is often desired to provide a wider seal extending up from the bottom of the package, and for that purpose a bottom sealing section, such as indicated at 30, should be employed.

Referring specifically to FIG. 15, the bottom sealing section 30 includes opposed flexible diaphrams 360 carrying horizontally disposed, electrical heating elements 362 on the outer faces thereof. Each of the diaphrams encloses a chamber 364 through which pressurized air can be introduced to expand the diaphrams, and thereby force the heating elements 362 toward each other to provide the desired horizontal heat seal adjacent the bottom of the pouch. Alternatively, a heating system employing a conductive block and diaphram of the type illustrated in FIGS. 13 and 14 can be employed. When the bottom sealer is being utilized, it is under the control of the same microswitch that controls the top sealing and side sealing operations.

Although the invention has been described with reference to the particular embodiments herein set forth, it is understood that the present disclosure has been made only by way of example and that numerous changes may be resorted to without departing from the spirit and scope of the invention. Thus, the scope of the invention should not be limited to the foregoing specification but rather by the scope of the claims appended hereto.

What is claimed is:

1. A packaging machine for forming pouches from a continuous web having confronting sections adapted to provide opposed walls of the formed pouches, said machine including cutting means for cutting discrete pouches from the continuous web; characterized in that positively driven feed means are provided for directing the continuous web material through the cutting means, said cutting means and feed means being adjustable in the machine-direction of travel of the web for setting the desired width of the pouches to be formed, drive means associated with the feed means and including elements movable with said feed means for automatically varying the speed of the feed means when the feed means is moved to thereby feed the desired length of continuous web through the cutting means between operating strokes of said cutting means to thereby control the width of the pouches severed from said web.

2. The packaging machine of claim 1 characterized by sealing means upstream of the cutting means, actuating means for operating the sealing means at predetermined intervals to form side seals of the formed pouches, said feed means directing the same desired length of continuous web past the sealing means between operating strokes of said sealing means as said feed means directs past the cutting means between operating strokes of said cutting means, whereby the longitudinal spacing between the side seals corresponds to the width of the pouches to be severed from the continuous web.

3. The packaging machine of claim 2 characterized in that the cutting means and feed means are retained on connected frame members to form a sub-assembly movable as a single unit for controlling the width of the pouches to be formed.

4. The packaging machine of claim 3 characterized by the inclusion of actuating means for operating the cutting means at the same frequency (i.e. operating strokes/minute) in all adjusted positions of the sub-assembly.

5. The packaging machine of claim 4 characterized by the inclusion of a transfer section located downstream of the cutting means for receiving a downstream side margin of the pouch prior to actuation of the cutting means to sever the pouch from the remainder of the continuous web, said sub-assembly being adjustable to change the machine-direction spacing between the cutting means and the transfer section to thereby vary the width of the pouch to be formed; the adjustment of the sub-assembly automatically varying the speed of operation of the feed means through the drive means associated with said feed means to thereby feed the continuous, sealed web through the cutting means and into engagement with the transfer section between operating strokes of said cutting means.

6. The packaging machine of claim 1 wherein the feed means includes at least one driven feed roll characterized in that the drive means for the feed roll includes an elongate rocker arm mounted for oscillating motion on a supporting shaft; means for oscillating said rocker arm; a sliding, toothed rack associated with the driven feed roll and movable along the length of the rocker arm as the feed roll is moved to adjust its machine-direction position, said rack having a linear driving stroke imparted to it by the oscillation of the rocker arm in one direction, the length of said driving stroke being directly related to the spacing of the rack from the shaft supporting the rocker arm; a gear meshing with said rack, said gear being secured through a one-way clutch means to a shaft carrying a feed roll to thereby rotate said feed roll; the speed of rotation of the meshing gear and driven feed roll being directly related to the length of the driving stroke of the toothed rack.

7. The packaging machine of claim 6 wherein the driven feed means includes opposed feed rolls defining a nip therebetween characterized in that cooperating gears are associated with the opposed rolls so that the motion imparted to the one driven roll through the action of the sliding toothed rack will automatically be transmitted to the other feed roll.

8. The packaging machine of claim 6 characterized in that the cutting means and feed means are retained on connected frame members to form a sub-assembly movable as a single unit for controlling the width of the pouches to be formed.

9. The packaging machine of claim 8 characterized by the inclusion of actuating means for operating the cutting means at the same frequency (i.e. operating strokes/minute) in all adjusted positions of the sub-assembly.

10. The packaging machine of claim 1 characterized by the inclusion of a transfer section located downstream of the cutting means for receiving a downstream side margin of the pouch prior to actuation of the cutting means to sever the pouch from the remainder of the continuous web, said sub-assembly being adjustable to change the machine-direction spacing between the cutting means and the transfer section to thereby vary the width of the pouch to be formed; the adjustment of the sub-assembly automatically varying the speed of operation of the feed means through the drive means associated with said feed means to thereby feed the continuous, sealed web through the cutting means and into engagement with the transfer section between operating strokes of said cutting means.

11. The packaging machine of claim 10 wherein the feed means includes at least one driven feed roll and the transfer section includes at least one driven transfer roll, further characterized in that the drive means for the feed roll and transfer roll includes a elongate rocker arm mounted for oscillating motion on a rotatably mounted shaft carrying the transfer roll; means for oscillating the rocker arm relative to said shaft; a sliding toothed rack associated with the feed roll and movable along the length of the rocker arm as the feed roll is adjusted, said rack having a linear driving stroke imparted to it by the oscillation of the rocker arm in one direction, the length of said driving stroke being directly related to the spacing of the rack from the shaft carrying the transfer roll; a gear meshing with said rack, said gear being secured through a one-way clutch means to a shaft carrying a feed roll of the feed means to thereby rotate said feed roll, the speed or rotation of the meshing gear and driven feed roll being directly related to the length of the driving stroke of the toothed rack; a gear secured to the rocker arm and mounted for oscillating motion with the rocker arm about the shaft carrying the transfer roll; an idler gear assembly driven by the oscillating gear secured to the rocker arm; a transfer roll drive gear secured to the shaft carrying the transfer roll through a one-way clutch means; an idler gear of the idler gear assembly cooperating with the transfer roll drive gear to intermittently drive the transfer roll in only one rotational direction through the one-way clutch means; the drive stroke for the transfer roll being the idle stroke for the feed roll and the drive stroke for the feed roll being the idle stroke for the transfer roll, whereby the transfer roll is stationary when the feed roll is being driven, and the feed roll is stationary when the transfer roll is being driven.

12. The packaging machine of claim 11 characterized in that the cutting means and feed means are retained on connected frame members to form a sub-assembly movable as a single unit for controlling the width of the pouches to be formed.

13. The packaging machine of claim 12 wherein the driven feed means includes opposed feed rolls defining a nip therebetween characterized in that cooperating gears are associated with the opposed rolls so that the motion imparted to the one driven roll through the action of the sliding toothed rack will automatically be transmitted to the other feed roll.

14. The packaging machine of claim 1 characterized by the inclusion of a rotatably mounted turret including a plurality of clamps located about the periphery thereof for receiving individual pouches severed from the continuous web; drive means for intermittently driving the turret to direct the individual pouches sequentially through a material filling station and a top sealing station; actuating means for opening said clamps after the pouches retained thereby have been sealed at the top sealing station to thereby unload the filled and sealed pouches.

15. The packaging machine of claim 14 characterized in that said clamps have opposed pouch-gripping members normally biased into a closed, gripping position; the actuating means for opening said clamps being located at the loading station where a pouch is received on the turret, and the unloading station where the filled and sealed pouch is unloaded.

16. The packaging machine of claim 14 including a vacuum system for separating the opposed pouch walls to open each pouch at the filling station, said system including opposed vacuum arms through which a vacuum is established, said arms having surfaces closely adjacent the opposed walls of the pouch; means for separating the vacuum arms from each other along an outwardly and downwardly inclined path for peeling the opposed pouch walls away from each other.

17. The packaging machine of claim 16 wherein each pouch is gripped by a clamp on the turret adjacent a side, sealed margin thereof, said means for retracting the vacuum arms also moving said arms in a direction toward the gripped side margin of the pouch as said pouch is being opened.

18. A vacuum system for opening a pouch sealed adjacent its side and bottom margins preparatory to filling the pouch with a material, said vacuum system including opposed vacuum arms through which a vacuum is established, said vacuum arms having an end adjacent to opposed walls of said pouch for imposing the vacuum on said opposed walls and means for retracting the vacuum arms along an outwardly and downwardly inclined path for peeling the pouch walls away from each other.

19. The vacuum system of claim 18 wherein each pouch is gripped by a clamp adjacent a side, sealed margin thereof, said means for retracting the vacuum arms also moving said arms laterally in a direction toward the gripped side margin of the pouch as said pouch is being opened.

20. The vacuum system of claim 18 including vacuum cups at the end of vacuum arms adjacent the pouch walls, said vacuum cups having flexible lips, the edges of said lips normally lying in a plane substantially perpendicular to the axis of the vacuum arms, said lips being pressed into sealing engagement with opposed pouch walls prior to establishing a vacuum through the vacuum arms so that the edges of the lips lie substantially in the same plane as the pouch walls prior to retracting the vacuum arms, whereby retraction of said vacuum arms in an outwardly and downwardly inclined path functions to peel the engaging pouch surfaces apart to open the pouch.

* * * * *